US011903454B2

(12) United States Patent
Kozuka et al.

(10) Patent No.: US 11,903,454 B2
(45) Date of Patent: Feb. 20, 2024

(54) LAST, METHOD FOR MANUFACTURING LAST, AND METHOD FOR MANUFACTURING FOOTWEAR UPPER

(71) Applicant: ASICS CORPORATION, Kobe (JP)

(72) Inventors: Yuya Kozuka, Kobe (JP); Genki Hatano, Kobe (JP); Shingo Takashima, Kobe (JP); Masanori Sakaguchi, Kobe (JP); Satoru Abe, Kobe (JP); Hironori Kitayama, Kobe (JP)

(73) Assignee: ASICS CORPORATION, Kobe (JP)

( * ) Notice: Subject to any disclaimer, the term of this patent is extended or adjusted under 35 U.S.C. 154(b) by 0 days.

(21) Appl. No.: 18/059,226

(22) Filed: Nov. 28, 2022

(65) Prior Publication Data

US 2023/0087513 A1 Mar. 23, 2023

Related U.S. Application Data

(62) Division of application No. 17/237,996, filed on Apr. 22, 2021, now Pat. No. 11,547,181.

(30) Foreign Application Priority Data

Apr. 24, 2020 (JP) ..... 2020-077796
Mar. 15, 2021 (JP) ..... 2021-041707

(51) Int. Cl.
*A43D 3/14* (2006.01)
*A43D 1/04* (2006.01)
*A43D 3/02* (2006.01)

(52) U.S. Cl.
CPC ..... *A43D 3/14* (2013.01); *A43D 1/04* (2013.01); *A43D 3/027* (2013.01)

(58) Field of Classification Search
CPC . A43D 3/00; A43D 3/02; A43D 3/021; A43D 3/027
See application file for complete search history.

(56) References Cited

U.S. PATENT DOCUMENTS

| | | | |
|---|---|---|---|
| 39,034 | A | 6/1863 | Clark |
| 838,874 | A | 12/1906 | Legge |
| 1,565,057 | A | 12/1925 | Frederick |
| 4,000,845 | A | 1/1977 | Zeller |

(Continued)

FOREIGN PATENT DOCUMENTS

| | | | |
|---|---|---|---|
| CN | 109732913 | A | 5/2019 |
| FR | 2865358 | A1 | 7/2005 |

OTHER PUBLICATIONS

The extended European search report issued by the European Patent Office dated Sep. 24, 2021, which corresponds to European Patent Application No. 21168427.9-1005 and is related to U.S. Appl. No. 17/237,996.

*Primary Examiner* — Ted Kavanaugh
(74) *Attorney, Agent, or Firm* — Studebaker & Brackett PC

(57) ABSTRACT

There is provided a user-dedicated last that can be easily manufactured without using large-scale equipment. A last for forming a footwear upper configuring an article of footwear comprises a foot length forming member defining a shape of the last at least in the lengthwise direction of the article of footwear, and a plurality of foot width forming members defining a shape of the last at least in the widthwise direction of the article of footwear and assembled to the foot length forming member.

15 Claims, 21 Drawing Sheets

(56) References Cited

U.S. PATENT DOCUMENTS

| | | | | |
|---|---|---|---|---|
| 6,896,175 | B2 | 5/2005 | Duke et al. | |
| 11,547,181 | B2 * | 1/2023 | Kozuka | A43D 3/027 |
| 2011/0277250 | A1 | 11/2011 | Angvin et al. | |
| 2016/0206049 | A1 | 7/2016 | Kallayil | |
| 2018/0014609 | A1 | 1/2018 | Bruce et al. | |
| 2020/0113291 | A1 * | 4/2020 | Smith | A43D 3/027 |

* cited by examiner

LAST, METHOD FOR MANUFACTURING LAST, AND METHOD FOR MANUFACTURING FOOTWEAR UPPER

This nonprovisional application is a Divisional of U.S. patent application Ser. No. 17/237,996 filed on Apr. 22, 2021, which is based on Japanese Patent Application No. 2021-041707 filed on Mar. 15, 2021 and No. 2020-077796 filed on Apr. 24, 2020, with the Japan Patent Office, the entire contents of which are hereby incorporated by reference.

BACKGROUND OF THE INVENTION

Field of the Invention

The present disclosure relates to a last, a method for manufacturing a last, and a method for manufacturing a footwear upper.

Description of the Background Art

When producing an article of footwear, a last (or a footwear model) for being covered with a cloth configuring a footwear upper is used in order to form the footwear upper into a predetermined shape.

U.S. Patent Application Publication No. 2018/0014609 discloses manufacturing an article of footwear in a portable housing. US 2016/0206049 discloses a last preform reformable with a shape memory polymer. Chinese Patent No. 109732913 discloses forming a last by 3D printing.

SUMMARY OF THE INVENTION

When making a made-to-order article of footwear fitting a user's feet, a dedicated last reflecting the shape of the feet of each individual is produced. Manufacturing a user-dedicated last in a conventional manner employs dedicated large-size equipment and requires time and cost.

The present disclosure proposes a user-dedicated last that can be easily manufactured without using large-scale equipment, a method for manufacturing the last, and a method for manufacturing a footwear upper using the last.

According to an aspect of the present disclosure, a last for forming a footwear upper configuring an article of footwear is proposed. The last comprises a foot length forming member that defines a shape of the last at least in a lengthwise direction of the article of footwear, and a plurality of foot width forming members that define a shape of the last at least in a widthwise direction of the article of footwear and are assembled to the foot length forming member.

According to an aspect of the present disclosure, a method for manufacturing a last for forming a footwear upper configuring an article of footwear is proposed. The method for manufacturing a last comprises the following steps. A first step is a step of preparing a foot length forming member that defines a shape of the last at least in the lengthwise direction of the article of footwear, and a plurality of foot width forming members that define a shape of the last at least in the widthwise direction of the article of footwear. A second step is a step of assembling the foot width forming member to the foot length forming member.

According to an aspect of the present disclosure, a method for manufacturing a footwear upper is proposed. The present method for manufacturing a footwear upper comprises the following steps. A first step is a step of covering the above-mentioned last with an unformed upper made of a fiber sheet including a heat-shrinkable yarn. A second step is a step of applying heat to form the unformed upper along the shape of the last to be a formed upper.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Hereinafter, embodiments will be described with reference to the drawings. In the following description, identical components are identically denoted. Their names and functions are also identical. Accordingly, such components will not be described repeatedly.

A last (or a footwear model) of an embodiment described below is mainly a last for a made-to-order article of footwear made to fit a user's foot. It should be noted, however, that the last of the embodiment is also applicable to a last for articles of footwear in mass production.

First Embodiment

Figure 1:
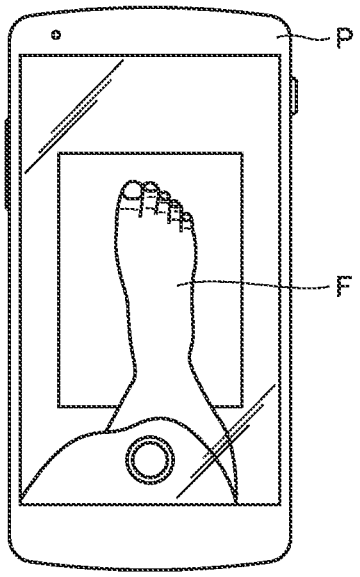
FIG. 1 is a diagram showing a user having his/her foot imaged to obtain a foot model.

FIG. 1 is a diagram showing a user having his/her foot F imaged to obtain a foot model FM. As shown in FIG. 1, a portable terminal capable of capturing an image, such as a smartphone P or a digital camera, is used to image the user's foot F to obtain image data of foot F. Image data of foot F can be obtained at a store visited by the user. The store may be a stationary store or a movable store using an automobile, a trailer, or the like. Alternatively, image data of foot F can be obtained at the user's home. The user per se may send his/her captured image data of foot F to a server of a footwear manufacturer.

Figure 2:
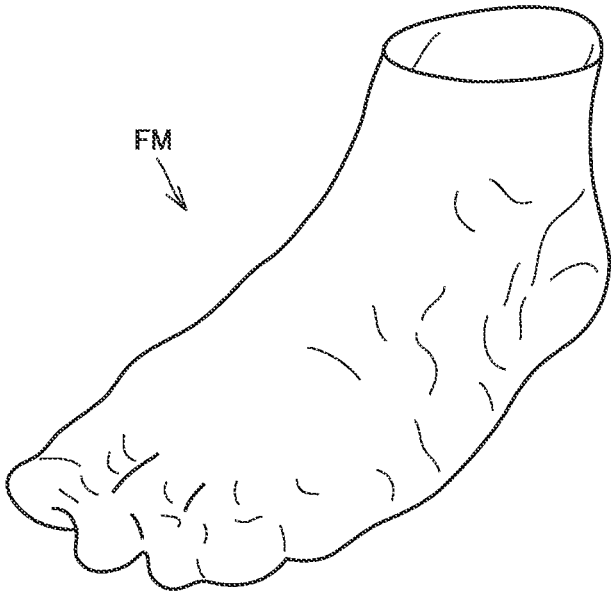
FIG. 2 is a perspective view of a foot model.

FIG. 2 is a perspective view of foot model FM. Foot model FM shown in FIG. 2 is a three-dimensional foot model generated from measured data of each part of foot F of the user obtained from image data of foot F. For example, when smartphone P is used to image the user's foot F, software previously installed in smartphone P can be used to generate foot model FM based on the image data. Alternatively, foot model FM can be generated by performing an operation on both the captured image data and data in a server used by a footwear manufacturer.

Foot model FM may be formed in the same shape as the user's foot F. Alternatively, for some reason in design or functionality, foot model FM may have a specific portion corrected from the shape of the user's foot F by a desired dimension.

Figure 3:
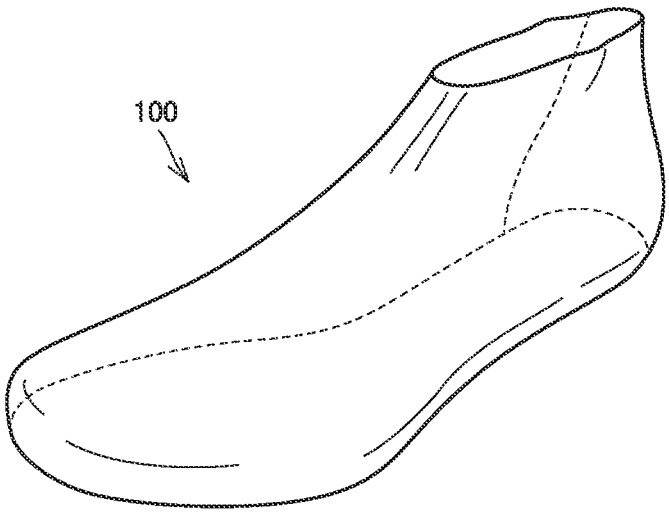
FIG. 3 is a perspective view of a last model.

FIG. 3 is a perspective view of a last model 100. Last model 100 shown in FIG. 3 is a model of a last created based on foot model FM shown in FIG. 2, and customized in accordance with the shape of the user's foot F. Forming a footwear upper using a last created in accordance with last model 100 allows a made-to-order article of footwear dedicated to the user to be manufactured.

Figure 4:
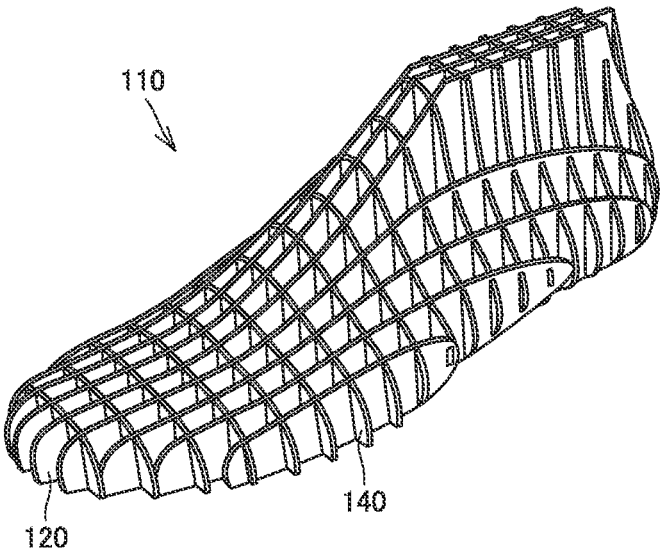
FIG. 4 is a perspective view of a cross-sectional last model.
Figure 5:
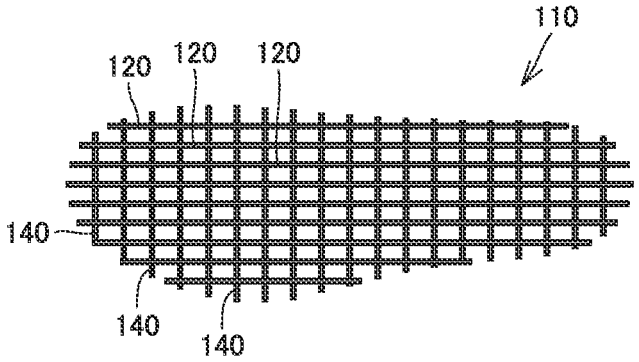
FIG. 5 is a plan view of the cross-sectional last model.

FIG. 4 is a perspective view of a cross-sectional last model 110. FIG. 5 is a plan view of cross-sectional last model 110. As shown in FIGS. 4 and 5, cross-sectional last model 110 is formed by a foot length forming model 120 and a foot width forming model 140. Foot length forming model 120 corresponds to a cross section of the FIG. 3 last model 100 along a lengthwise direction thereof. Foot width forming model 140 corresponds to a cross section of the FIG. 3 last model 100 along a widthwise direction thereof.

Note that in the present specification, a lengthwise direction refers to a direction along a straight line connecting a foremost end on a toe side and a rearmost end on a heel side when an article of footwear or a last is seen in plan view. A widthwise direction refers to a direction orthogonal to the lengthwise direction in plan view. A heightwise direction refers to a direction orthogonal to a plane defined by the lengthwise direction and the widthwise direction.

Figure 6:
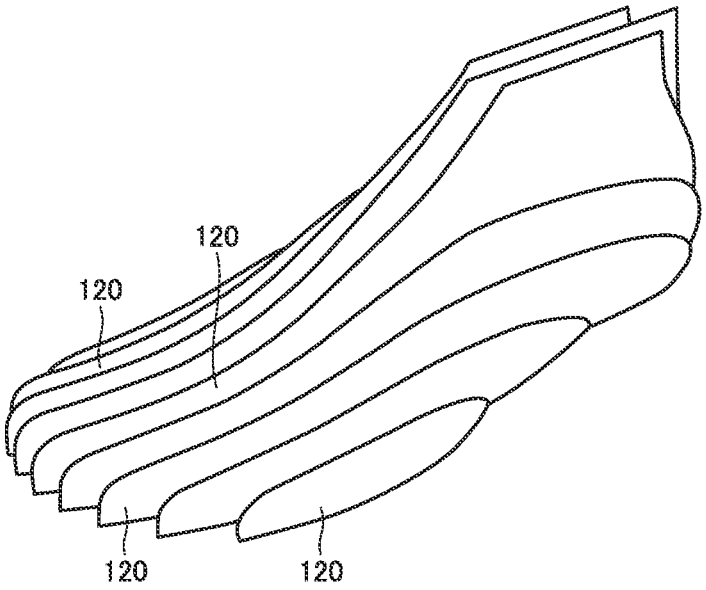
FIG. 6 is a perspective view showing only a foot length forming model of the cross-sectional last model.
Figure 7:
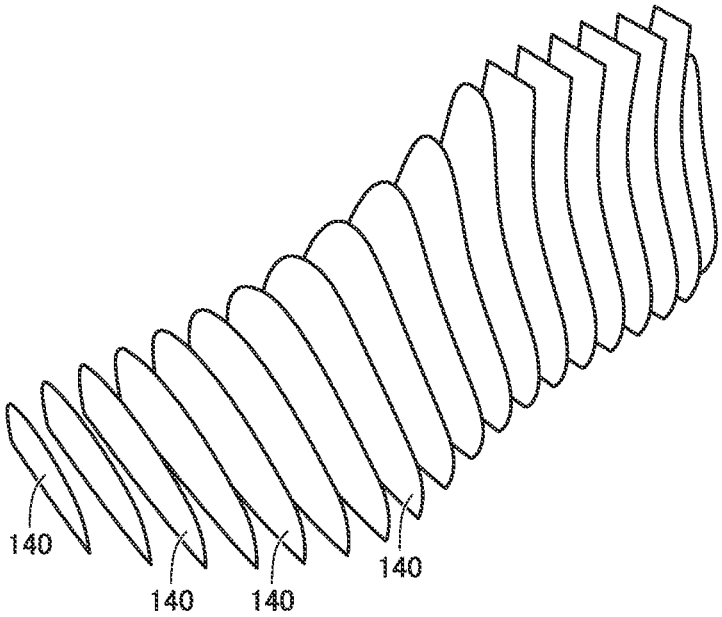
FIG. 7 is a perspective view showing only a foot width forming model of the cross-sectional last model.

Cross-sectional last model 110 is formed as a combination of a plurality of foot length forming models 120 extending in the lengthwise direction and a plurality of foot width forming models 140 extending in the widthwise direction. FIG. 6 is a perspective view showing only foot length forming model 120 of cross-sectional last model 110. FIG. 7 is a perspective view showing only foot width forming model 140 of cross-sectional last model 110. In the embodiment shown in FIGS. 4-7, the plurality of foot length forming models 120 are equally spaced and thus disposed in parallel. The plurality of foot width forming models 140 are equally spaced and thus disposed in parallel.

Figure 8:
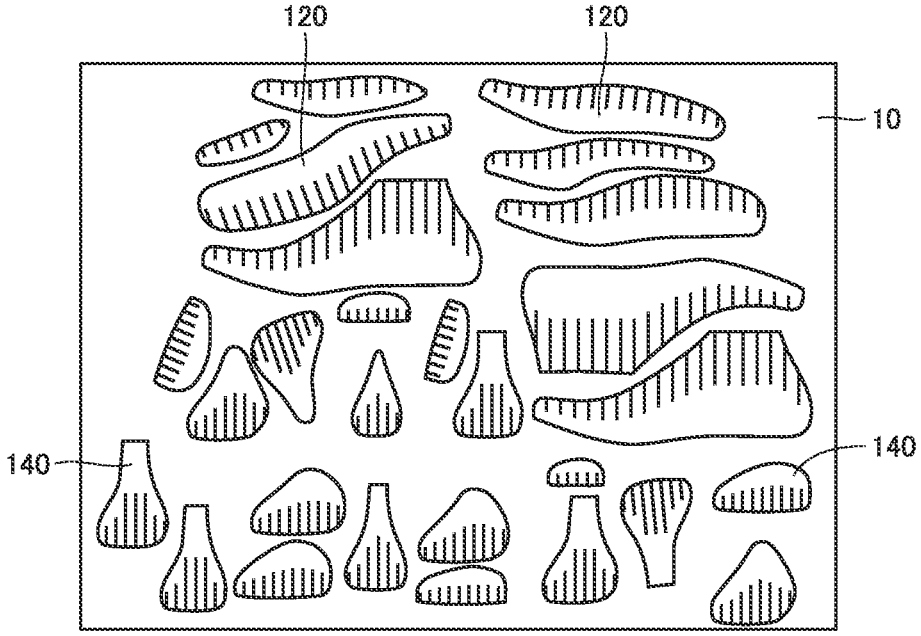
FIG. 8 is a schematic diagram showing a pattern in which the cross-sectional last model is disposed on a base member.

FIG. 8 is a schematic diagram showing a pattern in which cross-sectional last model 110 is disposed on a base member 10. Base member 10 is in the form of a flat plate and is made for example of paper. Base member 10 may be significantly recyclable cardboard. Alternatively, base member 10 is for example a flat plate made of resin. Base member 10 may be of thermoplastic resin or may be a butcher-block material such as cork or felt.

As shown in FIG. 8, cross-sectional last model 110, more specifically, a plurality of foot length forming models 120 and a plurality of foot width forming models 140 are disposed on base member 10. Densely disposing the plurality of foot length forming models 120 and the plurality of foot width forming models 140 on base member 10 to reduce a gap between foot length forming model 120 and foot width forming model 140 can reduce an amount of base member 10 wasted when parts of the last are cut out of base member 10. A nesting technique may be utilized to adjust positioning of foot length forming model 120 and foot width forming model 140 on base member 10. Nesting may be performed automatically by using dedicated software.

By processing base member 10 along foot length forming model 120 and foot width forming model 140 disposed on base member 10, parts of the last, more specifically, foot length forming member 20 and foot width forming member 40 described below, are formed. For example, foot length forming member 20 and foot width forming member 40 may be formed by cutting them out of base member 10 with a laser cutter or the like. Foot length forming member 20 and foot width forming member 40 formed from a single base member 10 are each in the form of a plate and equal in thickness.

Figure 9:
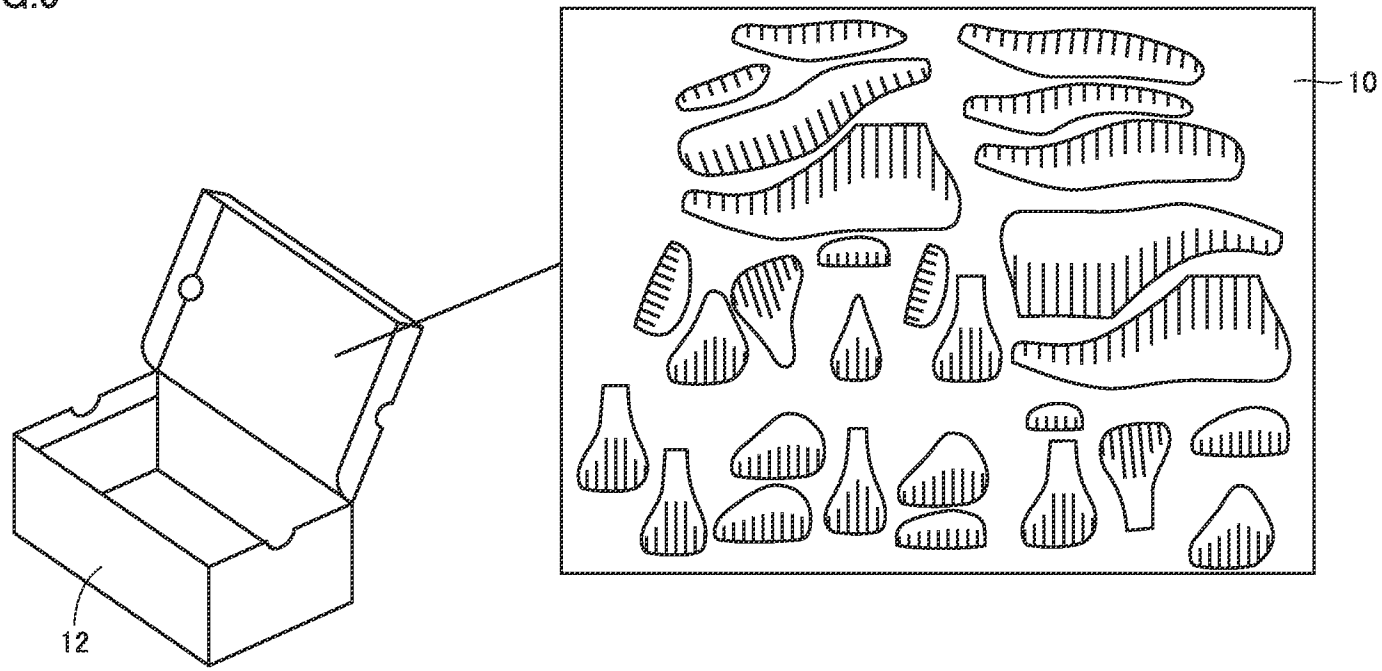
FIG. 9 is a schematic diagram showing an example in which the base member configures a part of a packing material.

FIG. 9 is a schematic diagram showing an example in which base member 10 configures a part of a packing material. When base member 10 is made of cardboard, base member 10 may configure a packing material for packing an article of footwear, more specifically, a box 12 for the article of footwear. In this case, foot length forming member 20 and foot width forming member 40 cut out of base member 10 will configure a part (e.g., an inner box) of box 12 for the article of footwear.

Figure 10:
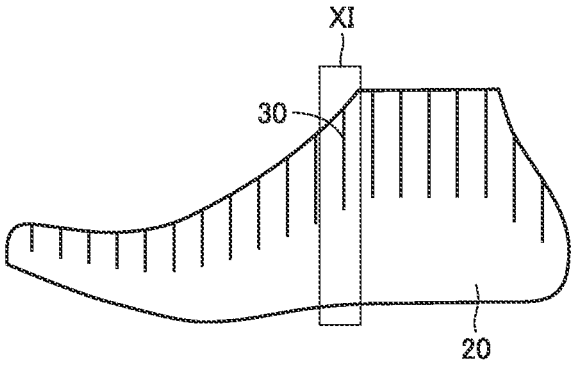
FIG. 10 is a side view of a foot length forming member.
Figure 11:
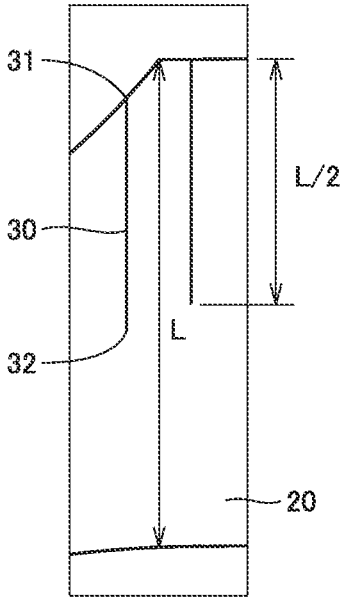
FIG. 11 is an enlarged view of a region XI shown in FIG. 9.
Figure 12:
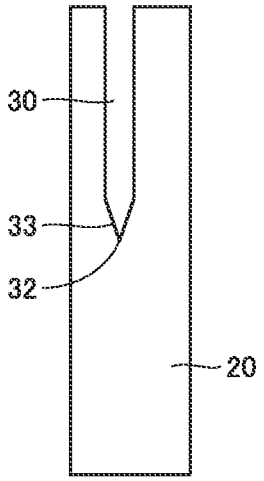
FIG. 12 is an enlarged view in a vicinity of a bottom of an engagement groove formed in the foot length forming member.

FIG. 10 is a side view of foot length forming member 20. FIG. 11 is an enlarged view of a region XI shown in FIG. 9. FIG. 12 is an enlarged view in a vicinity of a bottom 32 of an engagement groove 30 formed in foot length forming member 20. With reference to FIGS. 10 to 12, a specific one of a plurality of foot length forming members 20 formed as they are cut out of base member 10 in accordance with a plurality of foot length forming models 120 will be described as an example.

Base member 10 is in the form of a flat plate and foot length forming member 20 is formed as it is cut out of base member 10, and accordingly, foot length forming member 20 is also in the form of a plate. Foot length forming member 20 extends in the lengthwise direction of the last. Foot length forming member 20 defines a shape of the last at least in the lengthwise direction. Foot length forming member 20 defines a shape of the last in the lengthwise direction and the heightwise direction.

Foot length forming member 20 has a plurality of engagement grooves 30 formed therein. Engagement grooves 30 are aligned at equal intervals in the lengthwise direction. Each engagement groove 30 is in the form of a slit extending in the heightwise direction. Engagement groove 30 extends downward from an upper edge of foot length forming member 20. Engagement groove 30 has an opening 31 that opens at the upper edge of foot length forming member 20, and has a bottom 32 at an intermediate position that does not reach a lower edge of foot length forming member 20. As shown in FIG. 11, engagement groove 30 may have a length that is half a length from the upper edge to the lower edge of foot length forming member 20 at a position where engagement groove 30 is formed. As shown in FIG. 12, engagement groove 30 may have a tapered portion 33 that decreases the groove in width as it approaches bottom 32.

Figure 13:
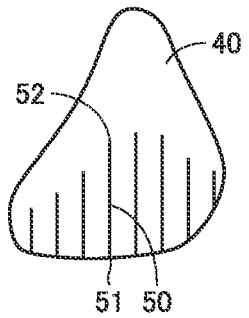
FIG. 13 is a front view of a foot width forming member.
Figure 14:
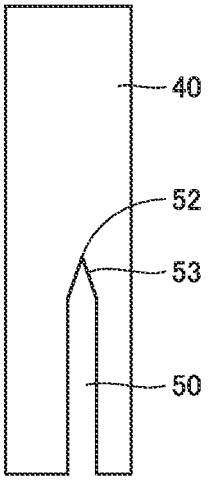
FIG. 14 is an enlarged view in a vicinity of a bottom of an engagement groove formed in the foot width forming member.

FIG. 13 is a front view of foot width forming member 40. FIG. 14 is an enlarged view in a vicinity of a bottom 52 of an engagement groove 50 formed in foot width forming member 40. With reference to FIGS. 13 and 14, a specific one of a plurality of foot width forming members 40 cut out of base member 10 in accordance with a plurality of foot width forming models 140 will be described as an example.

Base member 10 is in the form of a flat plate and foot width forming member 40 is formed as it is cut out of base member 10, and accordingly, foot width forming member 40 is also in the form of a plate. Foot width forming member 40 extends in the widthwise direction of the last. Foot width forming member 40 defines a shape of the last at least in the widthwise direction. Foot width forming member 40 defines a shape of the last in the widthwise direction and the heightwise direction. Foot width forming member 40 shown in FIG. 13 is generally in the form has a sector.

Foot width forming member 40 has a plurality of engagement grooves 50 formed therein. Engagement grooves 50 are aligned at equal intervals in the widthwise direction. Each engagement groove 50 is in the form of a slit extending in the heightwise direction. Engagement groove 50 extends upward from a lower edge of foot width forming member 40. Engagement groove 50 has an opening 51 that opens at the lower edge of foot width forming member 40, and has a bottom 52 at an intermediate position that does not reach an upper edge of foot width forming member 40. Engagement groove 50 may have a length that is half a length from the upper edge to the lower edge of foot width forming member 40 at a position where engagement groove 50 is formed. As shown in FIG. 14, engagement groove 50 may have a tapered portion 53 that decreases the groove in width as it approaches bottom 52.

Figure 15:
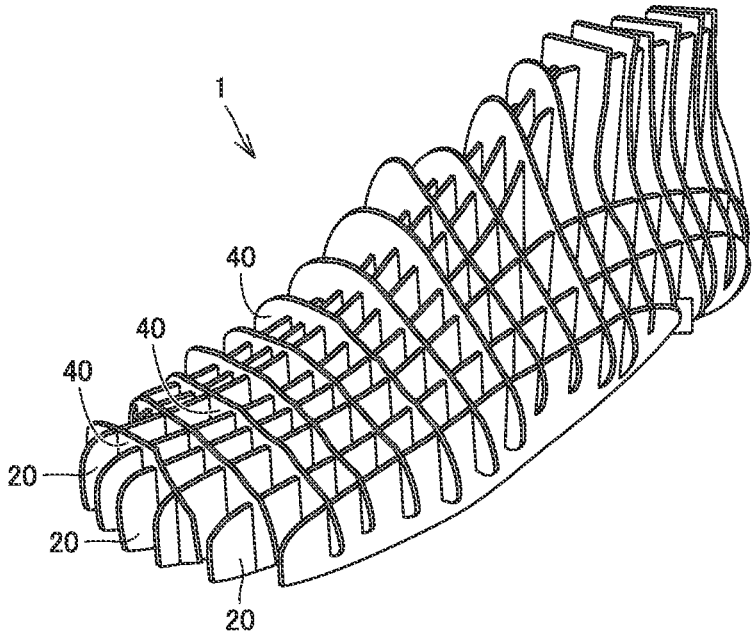
FIG. 15 is a perspective view of a last.

FIG. 15 is a perspective view of a last 1. Foot width forming member 40 is assembled to engagement groove 30 formed in foot length forming member 20, foot length forming member 20 is assembled to engagement groove 50 formed in foot width forming member 40, and a plurality of foot length forming members 20 and a plurality of foot width forming members 40 are thus alternately assembled to form last 1. The plurality of foot length forming members 20 are aligned in the widthwise direction of last 1. The plurality of foot width forming members 40 are aligned in the lengthwise direction of last 1.

Since foot length forming member 20 has engagement grooves 30 formed at equal intervals in the lengthwise direction, the plurality of foot width forming members 40 are equally spaced in the lengthwise direction. Since foot width forming member 40 has engagement grooves 50 formed at equal intervals in the widthwise direction, the plurality of foot length forming members 20 are equally spaced in the widthwise direction.

Figure 16:
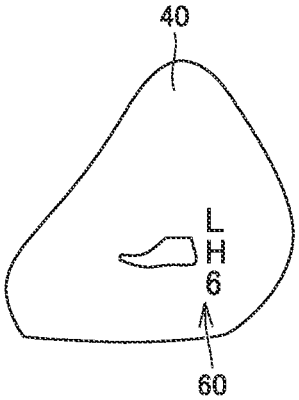
FIG. 16 is a schematic diagram showing a first example of a position identifier.
Figure 17:
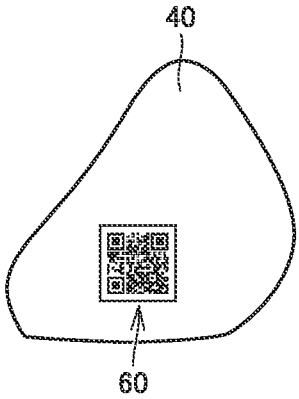
FIG. 17 is a schematic diagram showing a second example of the position identifier.
Figure 18:
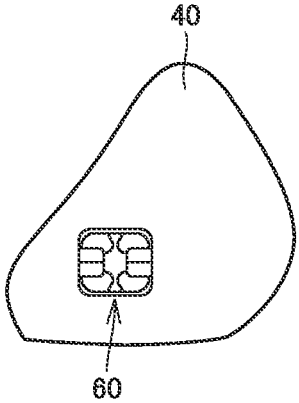
FIG. 18 is a schematic diagram showing a third example of the position identifier.

FIG. 16 is a schematic diagram showing a first example of a position identifier 60. Foot length forming member 20 and foot width forming member 40 may each have position identifier 60 indicating a position of foot length forming member 20 and that of foot width forming member 40 in last 1. The example shown in FIG. 16, and those shown in FIGS. 17 and 18 described hereinafter show position identifier 60 provided on foot width forming member 40. In FIGS. 16 to 18, for simplicity, engagement groove 50 formed in foot width forming member 40 is not shown.

Position identifier 60 has character information "L" indicating that foot width forming member 40 is a part of last 1 for a left foot, character information "H" indicating that foot width forming member 40 is foot width forming member 40, and character information "6" indicating that foot width forming member 40 is a sixth part as counted from a toe. Position identifier 60 has a mark. By matching the mark in direction, foot width forming member 40 can face in a correct direction, position identifier 60 is observable, and each piece of character information can be recognized correctly.

Position identifier 60 shown in FIG. 16 can be formed by laser printing. In this case, when foot length forming member 20 and foot width forming member 40 are cut out of base member 10, position identifier 60 can simultaneously be engraved on each of foot length forming member 20 and foot width forming member 40. Position identifier 60 may be printed on foot length forming member 20 and foot width forming member 40 using ink. Position identifier 60 may be provided by attaching a seal to foot length forming member 20 and foot width forming member 40.

FIG. 17 is a schematic diagram showing a second example of position identifier 60. Position identifier 60 may be implemented by coded information as shown in FIG. 17. While position identifier 60 shown in FIG. 17 is a matrixtype two-dimensional code representing information in a mosaic of vertically and horizontally disposed, black and white cells, position identifier 60 may be a different type of two-dimensional code or a one-dimensional code such as a bar code.

FIG. 18 is a schematic diagram showing a third example of position identifier 60. As shown in FIG. 18, position identifier 60 may be implemented by an integrated circuit (IC) chip. Position identifier 60 implemented by the coded information shown in FIG. 17 or the IC chip shown in FIG. 18 is previously provided to base member 10, and foot length forming member 20 and foot width forming member 40 may each be cut out of base member 10 so as to include position identifier 60. Alternatively, position identifier 60 may be attached to foot length forming member 20 and foot width forming member 40 after they are cut out.

Position identifier 60 is not limited to the above-described examples. For example, coloring engagement groove 30 of foot length forming member 20 and foot width forming member 40 to be assembled to engagement groove 30, and combining the same colors, allow an appropriate foot width forming member 40 to be assembled in an appropriate engagement groove 30.

While foot length forming member 20 and foot width forming member 40 may be assembled manually, they may be assembled automatically by a robot. The robot reads the positional information of foot length forming member 20 and foot width forming member 40 recorded in position identifier 60 and recognizes a position of position identifier 60 in foot length forming member 20 and foot width forming member 40, and thus ensures that foot length forming member 20 and foot width forming member 40 are each assembled in an appropriate position and an appropriate orientation.

Hereinafter, although there will be a description partially overlapping with the above description, a characteristic configuration as well as function and effect of the present embodiment will be listed below.

As shown in FIG. 15, last 1 of the embodiment includes foot length forming member 20 and foot width forming member 40. Foot length forming member 20 defines a shape of last 1 at least in the lengthwise direction. Foot width forming member 40 defines a shape of last 1 at least in the widthwise direction, and is assembled to foot length forming member 20.

Based on foot model FM of a target user, foot length forming member 20 and foot width forming member 40 are prepared by cutting them out of sheet-shaped base member 10. Foot width forming member 40 is assembled to foot length forming member 20 to form last 1. No large-scale equipment is required to prepare foot length forming member 20 and foot width forming member 40 and assemble foot width forming member 40 to foot length forming member 20. Thus, last 1 dedicated to the target user can be easily manufactured.

As shown in FIGS. 16 to 18, at least one of foot length forming member 20 and foot width forming member 40 may have position identifier 60 indicating a position of foot length forming member 20 and foot width forming member 40 in last 1. By referring to position identifier 60, a position at which foot length forming members 20 and foot width forming members 40 are each assembled can be easily recognized, and last 1 can be assembled faster. This allows last 1 to be manufactured through a more efficient operation.

As shown in FIGS. 10 and 15, foot length forming member 20 may be in the form of a plate. As shown in FIGS. 13 and 15, foot width forming member 40 may be in the form of a plate. All of the parts configuring last 1, that is, foot length forming member 20 and foot width forming member 40, can both be formed by cutting them out of sheet-shaped base member 10. This allows members configuring last 1 to be accommodated in a small space. Base member 10 or foot length forming member 20 and foot width forming member 40 having been cut out can be delivered in the form of a plate, that is, a small type of packing, and hence with a reduced cost.

As shown in FIGS. 10 to 12, foot length forming member 20 may have engagement groove 30 formed therein, and as shown in FIG. 15, foot width forming member 40 may be assembled in engagement groove 30 of foot length forming member 20. Inserting foot width forming member 40 into engagement groove 30 and assembling foot length forming member 20 and foot width forming member 40 together allow last 1 having a three-dimensional shape to be easily produced. Furthermore, doing so can also suppress disengagement of foot length forming member 20 and foot width forming member 40 when last 1 is moved after the members are assembled together. Appropriately adjusting engagement groove 30 in depth can determine a shape in the heightwise direction of last 1 assembled by inserting foot width forming member 40 into engagement groove 30 of foot length forming member 20.

As shown in FIG. 12, engagement groove 30 of foot length forming member 20 may have tapered portion 33 that decreases the groove in width as it approaches bottom 32. As shown in FIG. 14, engagement groove 50 of foot width forming member 40 may have tapered portion 53 that decreases the groove in width as it approaches bottom 52. Inserting foot width forming member 40 into engagement groove 30 and inserting foot length forming member 20 into engagement groove 50 to form last 1 can suppress disengagement of foot length forming member 20 and foot width forming member 40 when last 1 is moved after the members are assembled together. Forming tapered portions 33 and 53 in engagement grooves 30 and 50 to increase the grooves in width facilitates assembling foot length forming member 20 and foot width forming member 40 together. The grooves having bottoms 32, 52 reduced in width allow foot length forming member 20 and foot width forming member 40 to be properly positioned and properly assembled.

Instead of tapered portions 33 and 53, engagement grooves 30 and 50 may be provided with a different engagement means such as a protrusion. Engagement grooves 30 and 50 having their respective, internal protrusions engaged with each other can suppress disengagement of foot length forming member 20 and foot width forming member 40 and also allow foot length forming member 20 and foot width forming member 40 to be correctly assembled together.

As shown in FIGS. 8 and 9, foot length forming member 20 and foot width forming member 40 may be made of paper. Last 1 composed of parts made of paper can be light in weight. After last 1 is used to manufacture an article of footwear, last 1 can be recovered and recycled to reduce environmental burden. When foot length forming member 20 and foot width forming member 40 are made of cardboard, they will be in the form of fiber through water alone, and thus also recycled through a process with reduced environmental burden. Foot length forming member 20 and foot width forming member 40 may be made of thermoplastic resin, and in this case, after use, last 1 can be heated and thus molten for recycling, and thus reduce environmental burden.

As shown in FIG. 9, foot length forming member 20 and foot width forming member 40 may configure a part of a packing material for packing an article of footwear (i.e., box 12 for the article of footwear). Producing last 1 using a part of a material that has conventionally been used as a packing material, e.g., cardboard, eliminates the necessity of introducing an additional material for producing last 1, and also eliminates loss of material. Reduction in cost and environmental burden can thus be achieved.

Incorporating foot length forming member 20 and foot width forming member 40 into a packing material allows a user to bring foot length forming member 20 and foot width forming member 40 back to home. The user can assemble last 1 at home, and can use it when ordering the same article of footwear next time, use last 1 that is assembled as a shoe tree, store it as a child's growth record, etc.

As shown in FIGS. 1 to 3, foot model FM is generated from data of a captured image of a user's foot F, and last model 100 is generated based on foot model FM. As shown in FIGS. 4 to 7, foot width forming model 140 for forming foot width forming member 40 is generated by obtaining a shape of last model 100 in cross section in the widthwise direction. As shown in FIGS. 8 and 13, foot width forming member 40 is formed by processing base member 10 based on foot width forming model 140. Foot length forming member 20 can also be formed in a similar method. This ensures that last 1 is formed to have a shape corresponding to that of foot F of the user.

In the above description of the embodiment, an example has been described in which foot length forming member 20 and foot width forming member 40 are formed by cutting them out of base member 10. Foot length forming member 20 and foot width forming member 40 are not limited to being cut out of base member 10 in the form of a plate, and may be formed in other methods such as using a 3D printer.

Last 1 shown in FIG. 15 is formed by assembling plate-shaped foot length forming member 20 extending in the lengthwise direction and plate-shaped foot width forming member 40 extending in the widthwise direction to each other so as to be orthogonal to each other. Foot length forming member 20 may not necessarily be in the form of a flat plate extending in the lengthwise direction, and foot width forming member 40 may not necessarily be in the form of a flat plate extending in the widthwise direction. For example, foot length forming member 20 may have a shape curved so as to gradually increase a spacing toward the toe side of the foot, and foot width forming member 40 may have a shape curved so as to be orthogonal to each curved foot length forming member 20. Foot length forming model 120 and foot width forming model 140 may have their cross sections in a direction determined based on the curvature of the foot.

Second Embodiment

Figure 19:
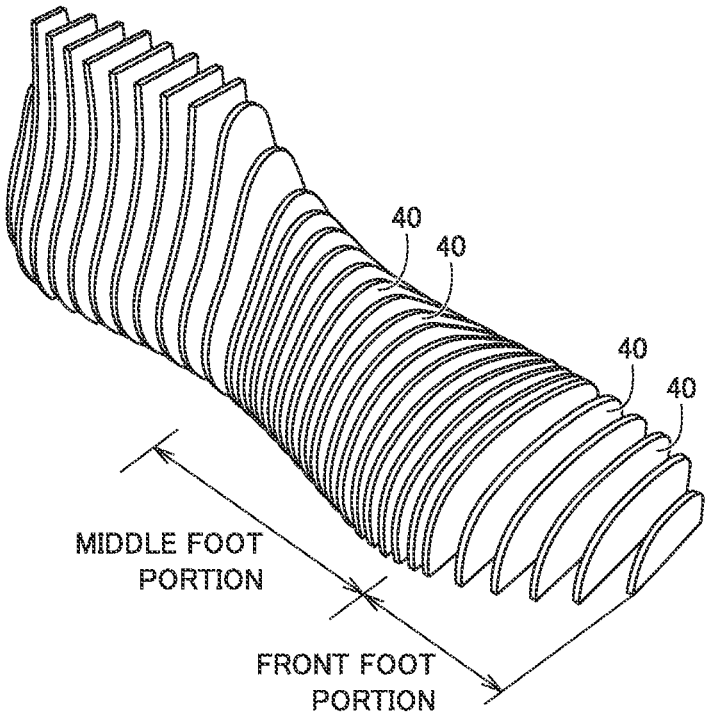
FIG. 19 is a perspective view showing only a foot width forming member of a last according to a second embodiment.

FIG. 19 is a perspective view showing only foot width forming member 40 of last 1 according to a second embodiment. As shown in FIG. 19, last 1 has defined a front foot portion and a middle foot portion. For example, the front foot portion may be defined by a region corresponding to a region from the toes to MTP joint of a wearer of an article of footwear in the lengthwise direction of the article of footwear, and the middle foot portion may be defined by a region corresponding to a region from the MTP joint to cuneiform bone of the wearer in the same direction. Further, for example, when a foremost end of last 1 on the side of the toes is a position of 0% and a rearmost end of last 1 on the side of the heel is a position of 100%, the front foot portion may be defined by a range of last 1 from 0% to 30-35% in the lengthwise direction, and the middle foot portion may be defined by a range behind the front foot portion to 50-55%.

Last 1 of the second embodiment has adjacent foot width forming members 40 spaced narrower in the middle foot portion than in the front foot portion. The front foot portion has a small variation in foot shape for each user, and the middle foot portion has a relatively large variation in foot shape for each user. Reducing a spacing between adjacent foot width forming members 40 in the middle foot portion that tends to have a difference in foot shape for each user allows last 1 to have a middle foot portion having a shape with improved accuracy.

Thus increasing/decreasing a spacing between foot width forming members 40 in the lengthwise direction allows last 1 to be produced to reflect the user's foot shape with high accuracy. Since a spacing between foot width forming members 40 in the front and rear foot portions that are less likely to have a difference in foot shape for each user is not excessively reduced, the number of parts is suppressed, and last 1 can be manufactured faster.

Third Embodiment

Figure 20:
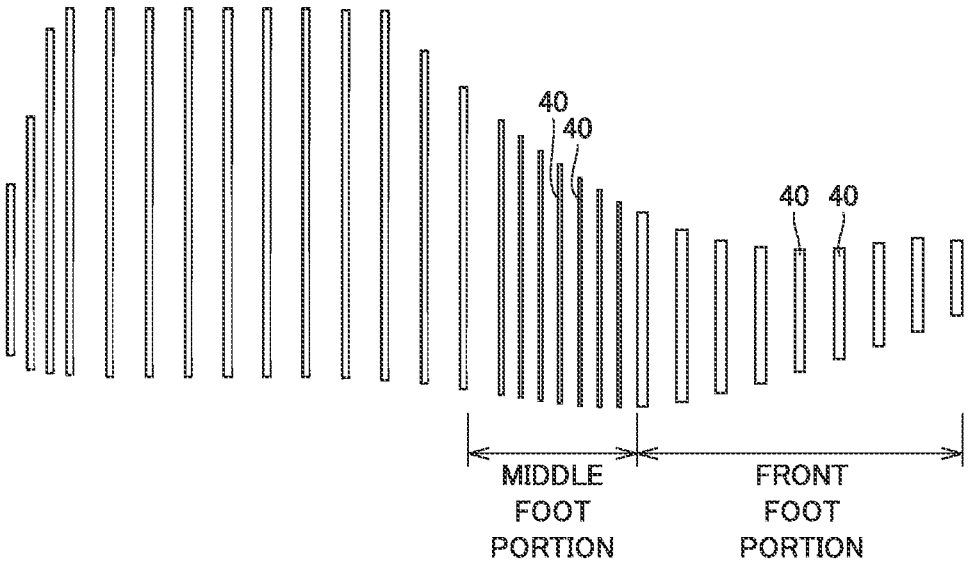
FIG. 20 is a side view showing only a foot width forming member of a last according to a third embodiment.

FIG. 20 is a side view showing only foot width forming member 40 of last 1 according to a third embodiment. Last in FIG. 20, as well as that in FIG. 19, has defined a front foot portion and a middle foot portion. Last 1 of the third embodiment has adjacent foot width forming members 40 spaced narrower in the middle foot portion than in the front foot portion. In addition, last 1 has foot width forming member 40 with a thickness smaller in the middle foot portion than in the front foot portion.

When the middle foot portion has foot width forming member 40 small in thickness, the middle foot portion can have adjacent foot width forming members 40 easily spaced narrower. This can further improve accuracy in shape of the middle foot portion of last 1, and last 1 can be produced to reflect the shape of the foot of the user with higher accuracy.

As shown in FIG. 20, adjacent foot width forming members 40 may also be spaced narrower at the heel portion of last 1. The heel portion also has a large difference in foot shape for each user, and accuracy in shape of last 1 can be further improved by also reducing a spacing between adjacent foot width forming members 40 in the heel portion.

Fourth Embodiment

Figure 21:
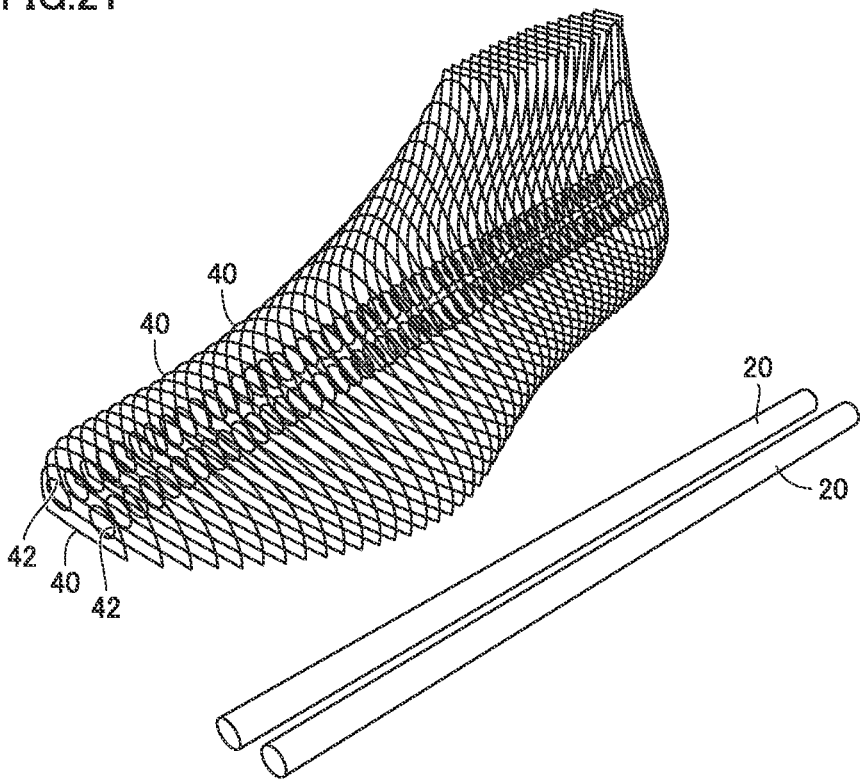
FIG. 21 is a disassembled perspective view of a last according to a fourth embodiment.
Figure 22:
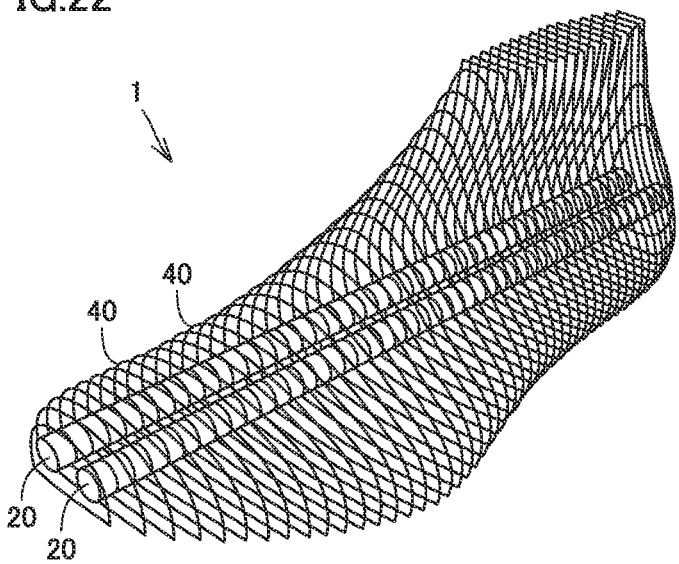
FIG. 22 is a perspective view of the last according to the fourth embodiment.
Figure 23:
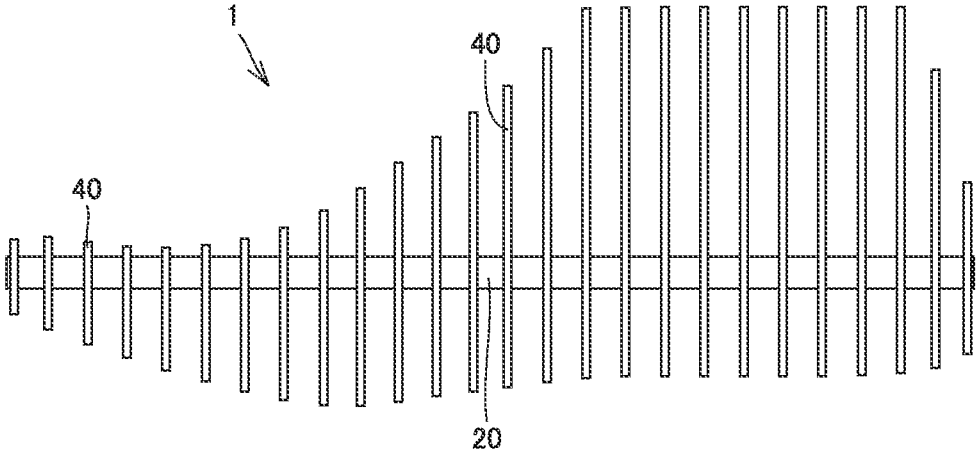
FIG. 23 is a side view of the last according to the fourth embodiment.

FIG. 21 is a disassembled perspective view of last 1 according to a fourth embodiment. FIG. 22 is a perspective view of last 1 according to the fourth embodiment. FIG. 23 is a side view of last 1 according to the fourth embodiment. While in the first embodiment an example has been described in which foot length forming member 20 is in the form of a plate, foot length forming member 20 is not limited in shape to a plate. As shown in FIGS. 21 to 23, foot length forming member 20 may be in the form of a rod extending in the lengthwise direction of an article of footwear or last 1. Foot width forming member 40 may have a throughhole 42 formed therethrough to allow rod-shaped foot length forming member 20 to pass therethrough.

By forming foot length forming member 20 in the form of a rod, forming throughhole 42 through plate-shaped foot width forming member 40, and passing rod-shaped foot length forming member 20 through throughhole 42, foot width forming member 40 can be assembled to foot length forming member 20. Thus, foot length forming member 20 and foot width forming member 40 can be assembled more easily and faster than in the first embodiment.

Last 1 can be easily disassembled by pulling foot length forming member 20 out of foot width forming member 40 through throughhole 42. This facilitates recycling foot width forming member 40. Foot length forming member 20 may be made of paper or resin and recycled in the same manner as foot width forming member 40, or foot length forming member 20 may be reused as it is.

Fifth Embodiment

Figure 24:
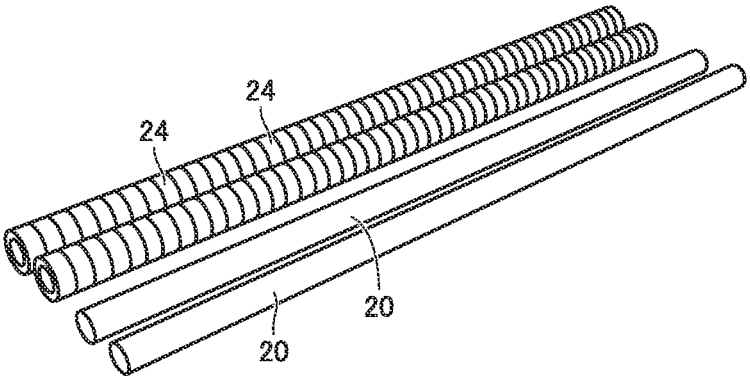
FIG. 24 is a disassembled perspective view of a foot length forming member according to a fifth embodiment.
Figure 25:
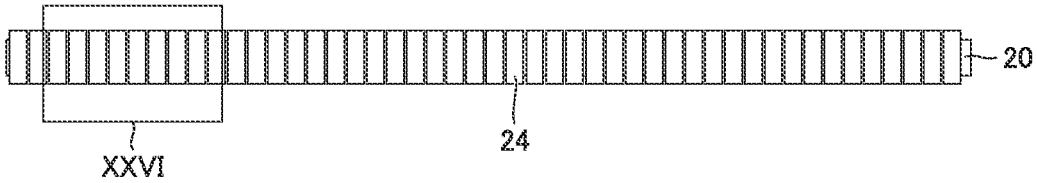
FIG. 25 is a side view of the foot length forming member according to the fifth embodiment.
Figure 26:
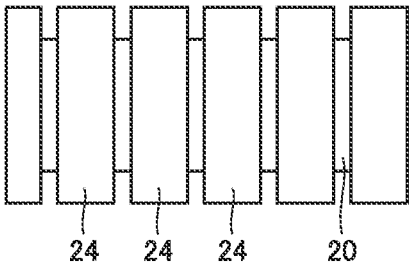
FIG. 26 is an enlarged view of a region XXVI shown in FIG. 25.
Figure 27:
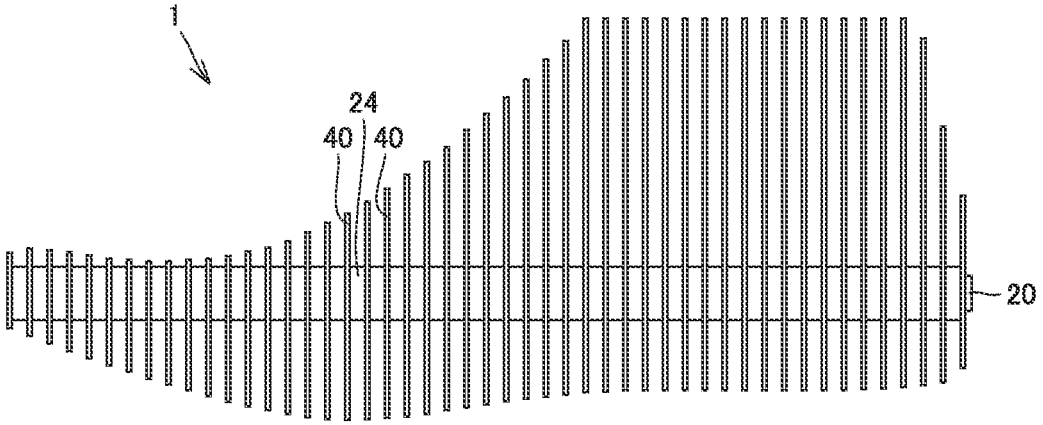
FIG. 27 is a side view of a last according to the fifth embodiment.

FIG. 24 is a disassembled perspective view of foot length forming member 20 according to a fifth embodiment. FIG. 25 is a side view of foot length forming member 20 according to the fifth embodiment. FIG. 26 is an enlarged view of a portion XXVI indicated in FIG. 25. FIG. 27 is a side view of last 1 according to the fifth embodiment. As well as the last in the fourth embodiment, last 1 in the fifth embodiment includes rod-shaped foot length forming member 20 and plate-shaped foot width forming member 40. A plurality of foot width forming members 40 are aligned in the lengthwise direction of an article of footwear or last 1. Last 1 further comprises a spacer 24 disposed between adjacent foot width forming members 40. Spacer 24 has an annular shape. Spacer 24 defines a spacing between adjacent foot width forming members 40.

When rod-shaped foot length forming member 20 is passed through throughhole 42 of foot width forming member 40, managing a dimension of a gap between adjacent foot width forming members 40 is required. By disposing spacer 24 between adjacent foot width forming members 40 separately from foot length forming member 20, a position where foot width forming member 40 is assembled with respect to foot length forming member 20 can be controlled. Foot width forming members 40 can thus be spaced as specified. For example, forming all spacers 24 identically in shape allows foot width forming members 40 to be equally spaced, and applying short spacer 24 to the middle foot portion can reduce a spacing between foot width forming members 40.

Last 1 shown in FIG. 27 can be formed by fitting foot width forming member 40 into a space in the form of a groove between adjacent spacers 24 in an assembly previously formed by assembling spacers 24 to foot length forming member 20, as shown in FIGS. 25 and 26. Alternatively, foot width forming member 40 and spacer 24 may be alternately attached to foot length forming member 20 to form last 1 shown in FIG. 27.

When throughhole 42 is formed in plate-shaped foot width forming member 40, throughhole 42 can be burred to circumferentially have a cylindrical wall to form a structure in which foot width forming member 40 and spacer 24 are integrated together. In this case, last 1 shown in FIG. 27 can be formed by sequentially attaching foot width forming member 40 to foot length forming member 20, and spacer 24 need not be assembled to foot width forming member 40 separately. This allows last 1 to be formed through a simplified operation and thus manufactured faster.

Sixth Embodiment

Figure 28:
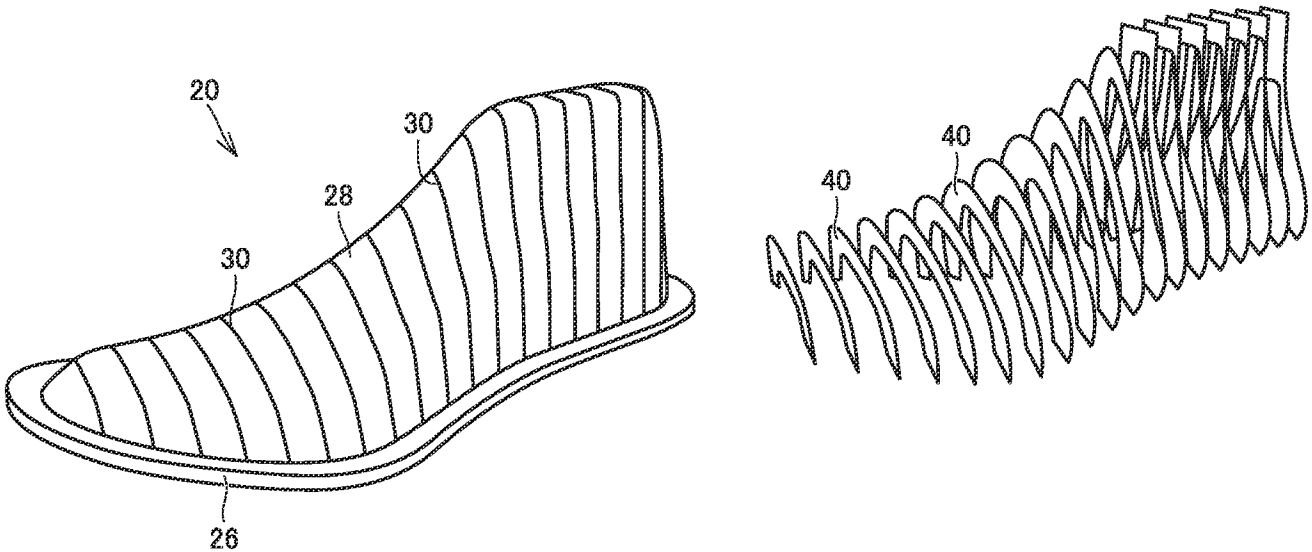
FIG. 28 is a disassembled perspective view of a last according to a sixth embodiment.
Figure 29:
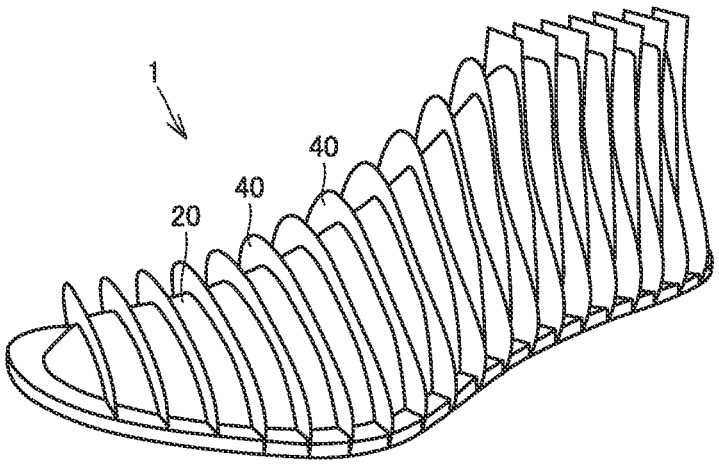
FIG. 29 is a perspective view of the last according to the sixth embodiment.

FIG. 28 is a disassembled perspective view of last 1 according to a sixth embodiment. FIG. 29 is a perspective view of last 1 according to the sixth embodiment. Foot length forming member 20 may have a three-dimensional shape in addition to the plate shape and rod shape as described above. Foot length forming member 20 shown in FIG. 28 has a base portion 26 and a core portion 28. Core portion 28 may be hollow or solid. Core portion 28 has a surface with engagement groove 30 formed therein. As shown in FIG. 29, last 1 is formed by assembling foot width forming member 40 into engagement groove 30. Foot width forming member 40 shown in FIGS. 28 and 29 is in the form of a partially notched annulus.

Base portion 26 has a shape corresponding to that of an upper surface of a footwear sole to which a footwear upper is bonded. Core portion 28 has a three-dimensional shape obtained by reducing last model 100 (see FIG. 3). Base portion 26 and core portion 28 are not changed in shape for each user; rather, they are previously prepared as a common member. Rather than cutting out all cross sections of last model 100 to provide foot width forming model 140, as described in the first embodiment, last 1 is previously determined to some extent in shape by base portion 26 and core portion 28. Plate-shaped foot width forming member 40 is inserted into engagement groove 30 that is provided in core portion 28 to form last 1 having a final shape corresponding to foot model FM of the user.

Last 1 is thus formed by fitting foot width forming member 40 into core portion 28 having a three-dimensional shape. Foot width forming member 40 can thus be easily assembled to foot length forming member 20. An area of foot width forming member 40 formed in accordance with the user's foot shape is reduced, and accordingly, an area of base member 10 used to cut out foot width forming member 40 can be reduced, and a user-dedicated last can be efficiently manufactured with a small amount of material. Engagement groove 30 formed in core portion 28 extends along a surface of core portion 28 having a three-dimensional shape and thus has the same curvature as the surface of core portion 28, and last 1 can achieve high reproducibility for a shape of a foot of a user.

Seventh Embodiment

Figure 30:
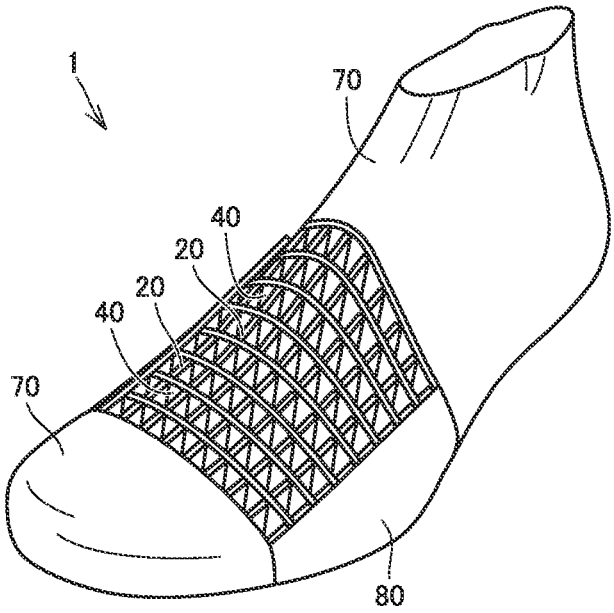
FIG. 30 is a perspective view of a last according to a seventh embodiment.

FIG. 30 is a perspective view of last 1 according to a seventh embodiment. While in the descriptions of the above-described embodiments, foot width forming member 40 is assembled to foot length forming member 20 along the entire length of last 1 in the lengthwise direction to form last 1 corresponding to a shape of a foot of a user, foot width forming member 40 may not necessarily be assembled along the entire length of last 1.

Last 1 shown in FIG. 30 comprises a common portion 70 invariable in shape and position at a toe portion and a portion extending from the middle foot portion to the heel portion corresponding a portion extending from the ankle of a foot to the arch of the foot. Last 1 also comprises a movable portion 80 that is invariable in shape and positionally variable at a portion of a foot corresponding to the tip of the first toe of the foot and that of the fifth toe of the foot. Therefore, last 1 has a structure in which foot length forming member 20 and foot width forming member 40 are assembled to each other only in a portion of the middle foot portion that corresponds to the instep of the foot.

That is, foot length forming member 20 does not necessarily define the shape of last 1 along the entire length of last 1 in the lengthwise direction. Foot length forming member 20 may be any such member that defines a shape of at least a portion of last 1 at least in the lengthwise direction. Similarly, foot width forming member 40 does not necessarily define the shape of last 1 along the entire width of last 1 in the widthwise direction. Foot width forming member 40 may be any such member that defines a shape of at least a portion of last 1 at least in the widthwise direction.

Figure 31:
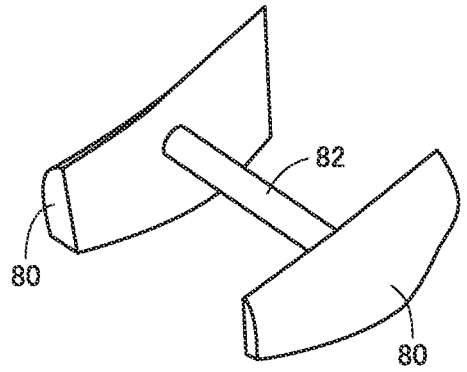
FIG. 31 is a perspective view of a movable portion.

FIG. 31 is a perspective view of movable portion 80. As shown in FIG. 31, a position adjustment mechanism 82 couples a pair of right and left movable portions 80. Position adjustment mechanism 82 changes a position of movable portion 80 with respect to common portion 70. After position adjustment mechanism 82 has changed the position of movable portion 80 via a fitting structure, a screwing structure or the like, position adjustment mechanism 82 can fix movable portion 80 in a predetermined position. For example, position adjustment mechanism 82 may include a tube of a larger diameter, a tube of a smaller diameter accommodated in the tube of the larger diameter and capable of reciprocating with respect to the tube of the larger diameter, and a locking portion for locking the tube of the smaller diameter with respect to the tube of the large diameter. The locking portion may be implemented as a snap lock, a pin lock, a lock nut, or the like.

Figure 32:
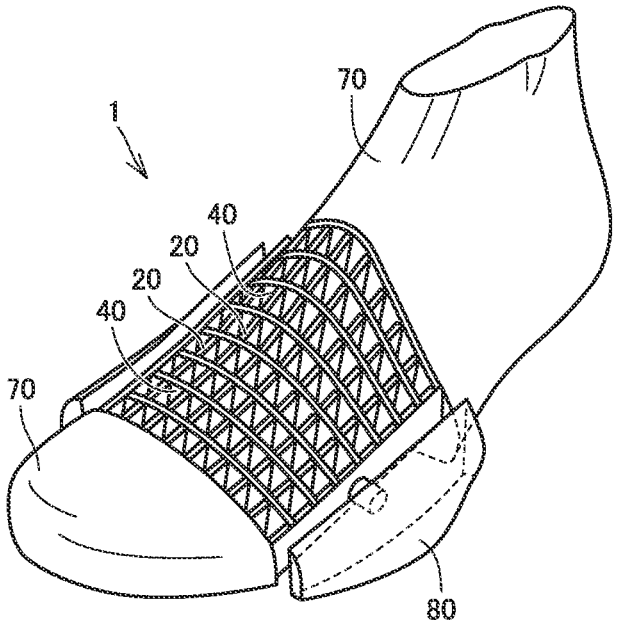
FIG. 32 is a perspective view of a last with the movable portion positionally changed.
Figure 33:
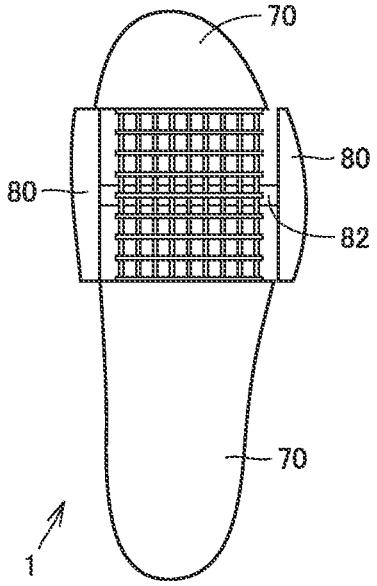
FIG. 33 is a plan view of the last with the movable portion positionally changed.

FIG. 32 is a perspective view of last 1 with movable portion 80 positionally changed. FIG. 33 is a plan view of last 1 with movable portion 80 positionally changed. As shown in FIGS. 32 and 33, movable portion 80 can change a widthwise dimension of last 1 in the middle foot portion. When position adjustment mechanism 82 changes a position of movable portion 80 to increase a distance between the paired, right and left movable portions 80, last 1 has a middle foot portion having an increased widthwise dimension. When position adjustment mechanism 82 changes a position of movable portion 80 to decrease a distance between the paired, right and left movable portions 80, last 1 has a middle foot portion having a decreased widthwise dimension.

Thus, last 1 using common portion 70 at a portion which is less likely to provide a difference in foot shape for each user and does not need to change last 1 in shape and position can have a reduced number of parts to be assembled and can hence be assembled in a reduced period of time. Forming a portion that provides a large difference in foot shape for each user and thus significantly affects an article of footwear in fitness by a combination of foot length forming member 20 and foot width forming member 40 exclusively for the user allows the user's foot shape to be better reproduced.

Using movable portion 80 at a portion where users are less likely to have a difference in shape while having a positional difference allows last 1 to be assembled in a reduced period of time. Simply positionally modifying an existing part allows last 1 to be adjusted in shape to match a shape of a foot of a user.

With reference to FIGS. 30 to 33 is described an example of last 1 in which a portion extending from a middle foot portion to a heel portion is formed as common portion 70. Instead of this example, last 1 may also comprise a movable portion in the heel portion. The movable portion for the heel portion may include a movable portion that is provided at a rearmost portion of the heel and can reciprocate in the lengthwise direction of last 1 and thus change a lengthwise dimension of last 1. The movable portion for the heel portion may include a movable portion that is provided to last 1 at a portion of a rear foot portion located on a side/sides corresponding to the lateral ankle and/or the medial ankle and is movable in the widthwise direction of last 1 to allow last 1 to have the rear foot portion with a variable widthwise dimension.

The movable portion for the heel portion may also be movable in the heightwise direction in addition to the lengthwise and widthwise directions. The movable portion for the heel portion may be angularly variable with respect to common portion 70. In this case, a cavity may be formed above and/or below the movable portion for the heel portion for allowing movement of the movable portion. After the movable portion is positionally adjusted, the cavity may be filled with any filler. The filler may be shaped to match the shape of the user's foot F.

Eighth Embodiment

Figure 34:
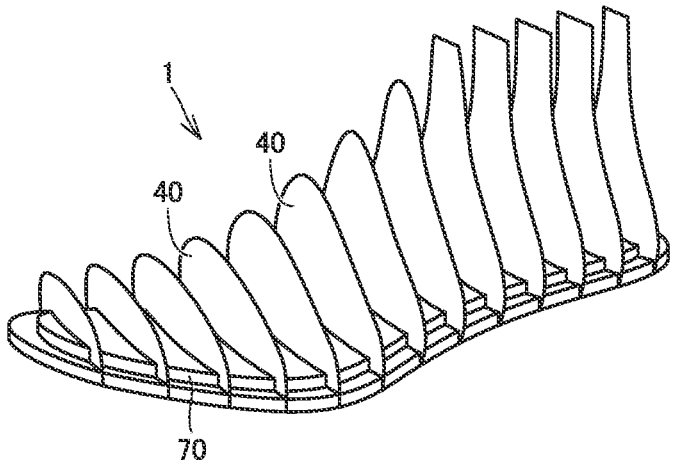
FIG. 34 is a perspective view of a last according to an eighth embodiment.

FIG. 34 is a perspective view of last 1 according to an eighth embodiment. Last 1 of the eighth embodiment has common portion 70 to configure a bottom surface of last 1. Common portion 70 has a shape corresponding to that of an upper surface of a footwear sole to which a footwear upper formed by last 1 is bonded. A groove is formed in common portion 70, and plate-shaped foot width forming member 40 is assembled into the groove. Common portion 70 shown in FIG. 34 also functions as foot length forming member 20.

When a footwear sole is formed in a mold, the footwear sole has a fixed shape regardless of a shape of a foot of a user. A bottom surface of a footwear upper that is bonded to the footwear sole has a fixed shape regardless of a shape of a foot of a user. As the footwear upper has the bottom surface fixed in shape, last 1 for forming the footwear upper also has a bottom surface fixed in shape. Accordingly, last 1 having a bottom surface portion in a shape that is common portion 70 can be stabilized in shape.

Figure 35:
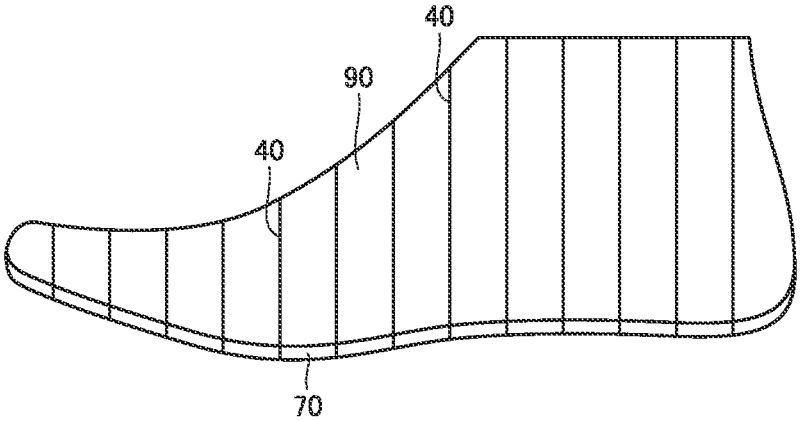
FIG. 35 is a side view of a last covered with a cover.

FIG. 35 is a side view of last 1 covered with a cover 90. Last 1 of the eighth embodiment shown in FIG. 34 or lasts 1 of the first to seventh embodiments described above may have at least a portion thereof externally covered with cover 90. As shown in FIG. 35, last 1 may entirely, externally be covered with cover 90. For last 1 having foot width forming member 40 only in a portion in the lengthwise direction, as shown in FIG. 30, cover 90 may have a shape that covers only a part of last 1 that at least covers an assembly of foot length forming member 20 and foot width forming member 40. Cover 90 may be in the form of a sheet, as shown in FIG. 35, or in the form of a plate.

When last 1 is covered with cover 90, last 1 of the embodiment can be used to form a footwear upper while suppressing an effect that a gap formed between foot length forming member 20 and foot width forming member 40 has on a shape that the footwear upper has after it is formed. This further ensures that the footwear upper is formed to have a predetermined shape.

Cover 90 may be a film that shrinks when it is heated, such as polystyrene film. In this case, last 1 can be covered with the film, which can in turn be heated and thus deformed to form cover 90 to cover a surface of last 1. In thermally deforming cover 90, (warm) air may be sent from the inside of cover 90. This can suppress excessive inward shrinkage of cover 90 between adjacent foot length forming members 20 and adjacent foot width forming members 40 and can further increase accuracy in forming a footwear upper.

Cover 90 may be metal foil represented by aluminum foil, and in this case, covering a surface of last 1 with metal enhances thermal conductivity, which is advantageous in heating and thus forming a footwear upper, as will be described hereinafter. Alternatively, cover 90 may be a sock.

Ninth Embodiment

Figure 36:
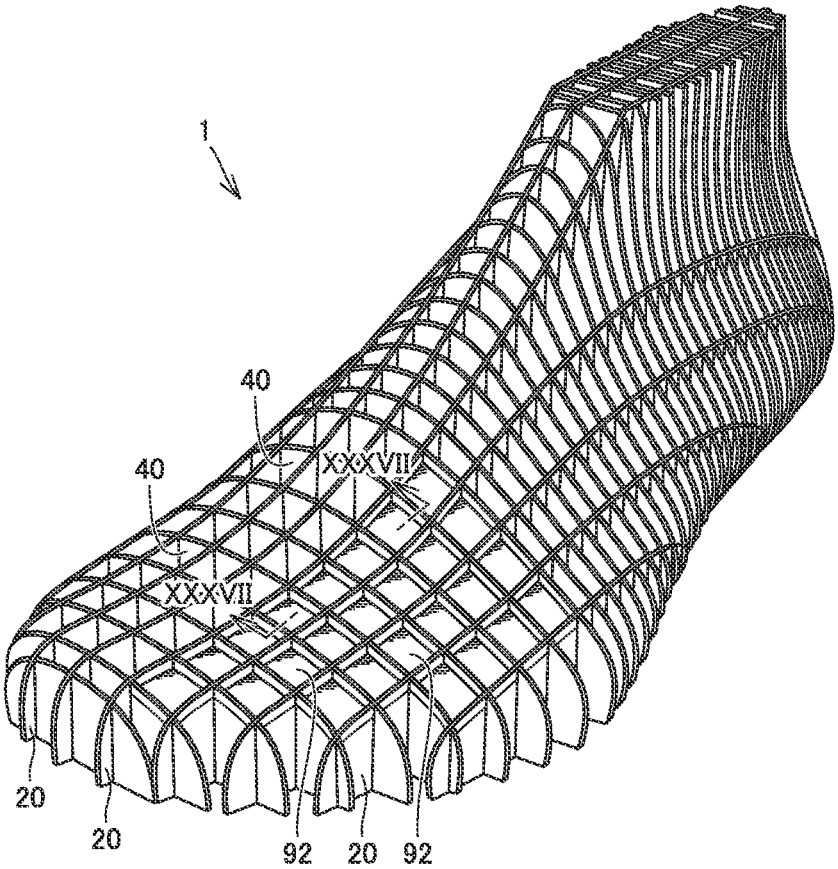
FIG. 36 is a perspective view of a last according to a ninth embodiment.
Figure 37:
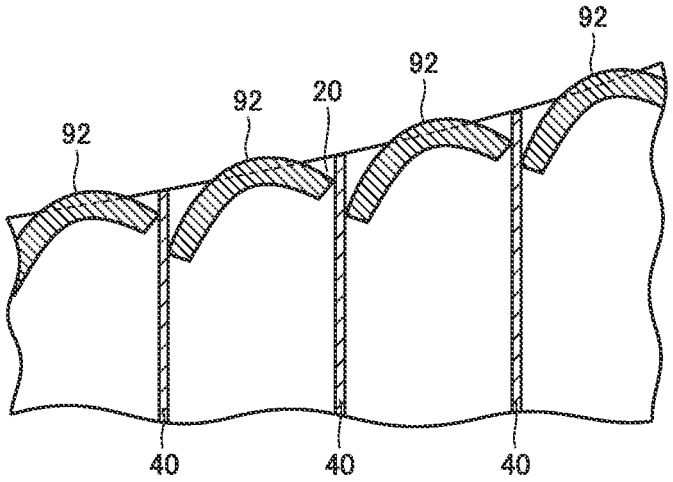
FIG. 37 is a partial cross section of the last taken along a line XXXVII-XXXVII indicated in FIG. 36.

FIG. 36 is a perspective view of last 1 according to a ninth embodiment. FIG. 37 is a partial cross section of last 1 taken along a line XXXVII-XXXVII indicated in FIG. 36. Instead of cover 90 described with reference to FIG. 35, last 1 of the ninth embodiment has a cap 92 inserted into a space defined by foot length forming member 20 and foot width forming member 40. While FIG. 36 shows cap 92 only in some of spaces defined by foot length forming member 20 and foot width forming member 40 for simplicity, it is desirable that cap 92 be provided at least in an outermost peripheral portion of last 1, and it is more desirable that cap 92 be provided throughout last 1.

As shown in FIG. 37, cap 92 has a curved cross section. Cap 92 may have a shape of a portion of a spherical surface. Cap 92 protrudes from upper edges of foot length forming member 20 and foot width forming member 40.

Cap 92 allows last 1 to have a smoothly curved external surface. When last 1 is used to form a footwear upper, cap 92 can prevent an end surface of foot length forming member 20 and/or foot width forming member 40 from being transferred to the footwear upper and prevent a gap between foot length forming member 20 and foot width forming member 40 from affecting the shape of the footwear upper. This further ensures that the footwear upper is formed to have a predetermined shape.

Figure 38:
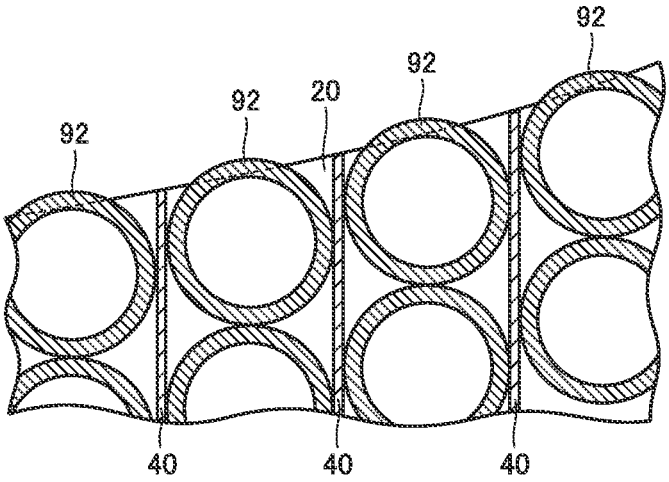
FIG. 38 is a partial cross section of a last comprising a spherical cap.

FIG. 38 is a partial cross section of last 1 comprising cap 92 in the form of a sphere. Instead of cap 92 having a curved shape shown in FIG. 37, cap 92 may be spherical as shown in FIG. 38. Although FIG. 38 illustrates cap 92 that is a hollow sphere, cap 92 may be a solid sphere.

Tenth Embodiment

Figure 39:
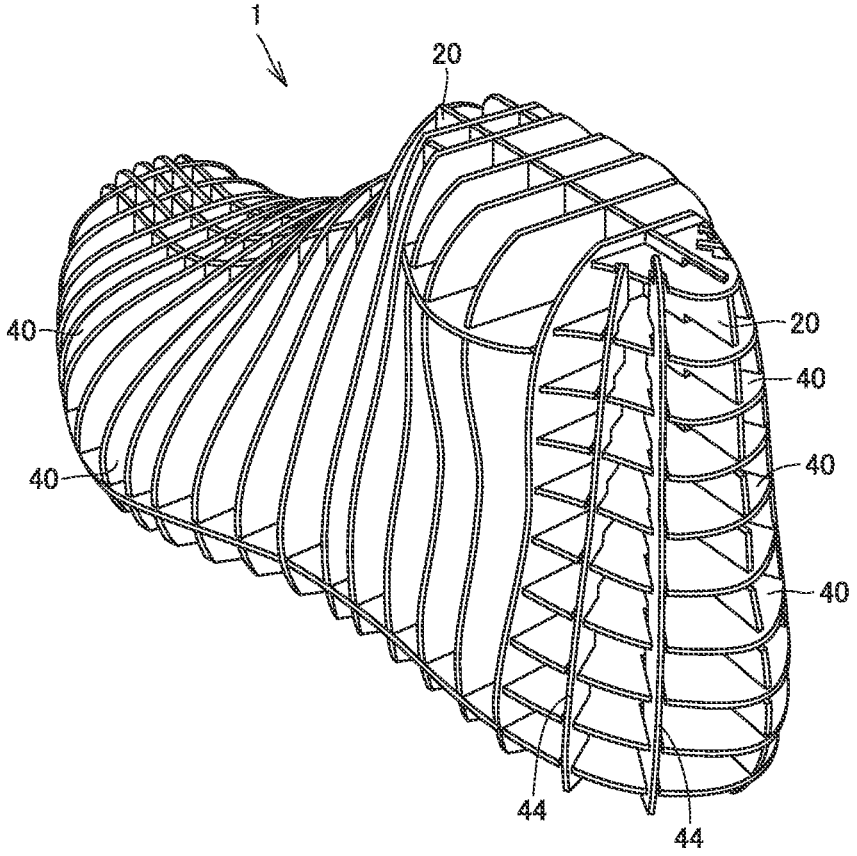
FIG. 39 is a perspective view of a last according to a tenth embodiment.
Figure 40:
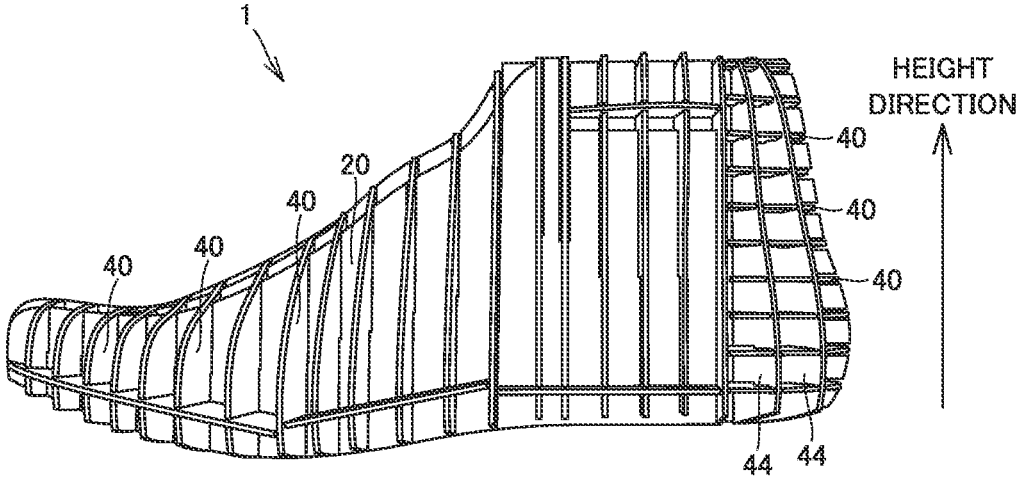
FIG. 40 is a side view of the last according to the tenth embodiment.

FIG. 39 is a perspective view of last 1 according to a tenth embodiment. FIG. 40 is a side view of last 1 according to the tenth embodiment. As well as the lasts in the first to third embodiments, last 1 in the tenth embodiment has plate-shaped foot length forming member 20 and plate-shaped foot width forming member 40. In the front foot portion and the middle foot portion, last 1 of the tenth embodiment, as well as the first to third embodiments, has foot width forming members 40 aligned in the lengthwise direction of last 1.

Last 1 of the tenth embodiment is characterized by a configuration of foot width forming member 40 at a portion corresponding to a heel portion of a foot. Specifically, at the portion corresponding to the heel portion of the foot, foot width forming members 40 are aligned in the heightwise direction of last 1. In the heel portion of last 1, foot length forming member 20 has formed therein a plurality of engagement grooves 30 aligned at equal intervals in the heightwise direction. In the heel portion of last 1, a plurality of foot width forming members 40 are assembled in engagement grooves 30 and thus aligned at equal intervals in the heightwise direction. It should be noted that the pitch of the plurality of foot width forming members 40 may be fixed or changed to be smaller for a portion which requires accuracy, in particular, than other portions.

A radial engagement groove 50 is formed in each of foot width forming members 40 in the heel portion. A plate-shaped engagement member 44 extending in the heightwise direction is assembled in radial engagement groove 50. Combining a plurality of foot width forming members 40 and a plurality of engagement members 44 in the form of a grid enhances the heel portion of last 1 in strength.

The heel portion has a relatively large variation in foot shape for each user. In addition, when the heel portion is compared with other portions, the former has a surface of a foot having protrusion and depression with significant variation in shape. A plurality of foot width forming members 40 aligned in the heightwise direction can reproduce a shape of a foot better than using foot width forming member 40 that extends in the heightwise direction to form a heel portion of last 1. This can further improve accuracy in shape of last 1, and last 1 can be produced to reflect the shape of the foot of the user with higher accuracy.

Eleventh Embodiment

Figure 41:
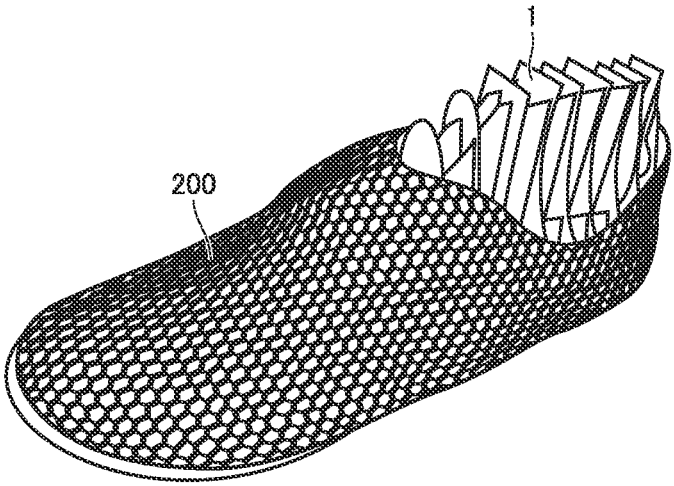
FIG. 41 is a perspective view showing a last covered with an unformed upper.

In an eleventh embodiment will be described one example of a method for manufacturing a footwear upper using last 1 described in the above embodiments. FIG. 41 is a perspective view showing last 1 covered with an unformed upper 200. For example, a material made of a fiber sheet including a heat-shrinkable yarn (i.e., unformed upper 200) is prepared for a footwear upper. Last 1 is covered with unformed upper 200 larger than the external shape of last 1 to obtain the configuration shown in FIG. 41.

Figure 42:
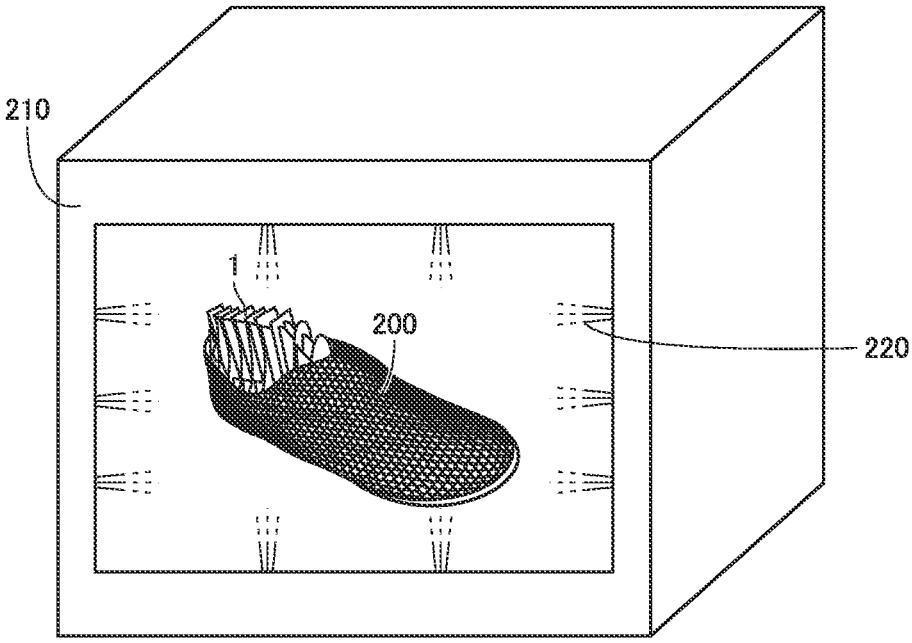
FIG. 42 is a schematic diagram of a process of heating the unformed upper covering the last.

FIG. 42 is a schematic diagram of a process of heating unformed upper 200 covering last 1. As shown in FIG. 42, last 1 covered with unformed upper 200 is accommodated in a heating box 210. In this state, hot steam 220 is discharged from an internal surface of heating box 210. Thus, unformed upper 200 is heated with steam. By this heating with steam, unformed upper 200 is entirely, uniformly heated. The heating can cause the heat-shrinkable yarn to shrink to allow unformed upper 200 to be a formed upper along the shape of last 1.

Through such a manufacturing process, a footwear upper matching a user's foot F in shape and thus dedicated to the user can be manufactured without using large-scale equipment.

Heating box 210 may be a steam oven. While unformed upper 200 is heated with steam, unformed upper 200 may be heated with hot air, warm water or the like. Unformed upper 200 may be heated partially rather than entirely. The thus formed upper is attached to a separately formed footwear sole through adhesion, thermal fusion bonding, or the like.

While each step is performed or after the whole process is completed, a footwear tongue is formed, a footwear opening is processed, eyelets are attached for passing a footwear lace therethrough, an ornament and a tag are attached, a logo is printed, an insole is attached and the like to manufacture an article of footwear.

The method for manufacturing the footwear upper is not limited to thermal shrinkage of a fiber sheet including a heat-shrinkable yarn, as described above, and a variety of methods may be employed, for example, knitting a material around last 1 directly, additive manufacturing with a 3D printer, or the like. It is also possible to use last 1 of the embodiments in a conventionally known process of forming a footwear upper in a factory.

Summary of Disclosure in Embodiments or the Like

The characteristic configurations disclosed in the above-described embodiments and modifications thereof will be summarized as follows.

A last according to an embodiment of the present disclosure is directed to forming a footwear upper configuring an article of footwear. The last comprises a foot length forming member that defines a shape of the last at least in a lengthwise direction of the article of footwear, and a plurality of foot width forming members that define a shape of the last at least in a widthwise direction of the article of footwear and are assembled to the foot length forming member.

In a last according to an embodiment of the present disclosure, at least one of the foot length forming member and the foot width forming member may have a position identifier that indicates a position of the foot length forming member and the foot width forming member in the last.

In a last according to an embodiment of the present disclosure, a plurality of foot width forming members may be aligned in the lengthwise direction, and adjacent foot width forming members may be spaced narrower in a middle foot portion of the last than in a front foot portion of the last.

In a last according to an embodiment of the present disclosure, the foot width forming member may be in the form of a plate, a plurality of foot width forming members may be aligned in the lengthwise direction, and the foot width forming member may be smaller in thickness in the middle foot portion of the last than in the front foot portion of the last.

A last according to an embodiment of the present disclosure may have a heel portion with a plurality of foot width forming members aligned in the heightwise direction.

In a last according to an embodiment of the present disclosure, the foot length forming member may be in the form of a rod extending in the lengthwise direction and the foot width forming member may have a throughhole formed therein to pass the foot length forming member therethrough.

A last according to an embodiment of the present disclosure may have a plurality of foot width forming members aligned in the lengthwise direction and may further comprise a spacer disposed between adjacent foot width forming members to define a spacing between the adjacent foot width forming members.

In a last according to an embodiment of the present disclosure, the foot length forming member may be in the form of a plate.

In a last according to an embodiment of the present disclosure, the foot length forming member may have a hollow or solid three-dimensional shape.

In a last according to an embodiment of the present disclosure, the foot length forming member may have an engagement groove, and the foot width forming member may be assembled to the engagement groove.

In a last according to an embodiment of the present disclosure, the foot width forming member may have a second engagement groove, the foot length forming member may be assembled to the second engagement groove, and the engagement groove and the second engagement groove may each have a tapered portion allowing the groove to have a width reduced as it approaches the bottom of the groove.

In a last according to an embodiment of the present disclosure, the foot length forming member and the foot width forming member may be formed of paper.

In a last according to an embodiment of the present disclosure, the foot length forming member and the foot width forming member may configure a part of a packing material for packing an article of footwear.

A last according to an embodiment of the present disclosure may further comprise a common portion invariable in shape and position.

In a last according to an embodiment of the present disclosure, the common portion may configure a bottom surface of the last and have a shape corresponding to that of an upper surface of a footwear sole to which a footwear upper is bonded.

A last according to an embodiment of the present disclosure may further comprise a movable portion invariable in shape and positionally variable.

A last according to an embodiment of the present disclosure may further comprise a cover in the form of a sheet or a plate and externally covering at least a portion of the last.

A method for manufacturing a last according to an embodiment of the present disclosure is a method for manufacturing a last for forming a footwear upper configuring an article of footwear. The method for manufacturing a last comprises the following steps. A first step is a step of preparing a foot length forming member that defines a shape of the last at least in the lengthwise direction of the article of footwear, and a plurality of foot width forming members that define a shape of the last at least in the widthwise direction of the article of footwear. A second step is a step of assembling the foot width forming member to the foot length forming member.

In a method for manufacturing a last according to an embodiment of the present disclosure, the step of preparing the foot length forming member and the foot width forming member may include the steps of: generating a foot model for a user; generating a foot width forming model from the foot model for forming the foot width forming member; and processing a base member based on the foot width forming model to form the foot width forming member.

A method for manufacturing a footwear upper according to an embodiment of the present disclosure comprises the following steps. A first step is a step of covering the last of any one of the above aspects with an unformed upper made of a fiber sheet including a heat-shrinkable yarn. A second step is a step of applying heat to form the unformed upper along the shape of the last to be a formed upper.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A method for manufacturing a last for forming a footwear upper configuring an article of footwear, the method comprising:

disposing a plurality of foot length forming models and a plurality of foot width forming models on a base member in the form of a flat plate;

processing the base member in accordance with the foot length forming models and the foot width forming models to form a plurality of foot length forming members that define a shape of the last at least in a lengthwise direction of the article of footwear, and a plurality of foot width forming members that define a shape of the last at least in a widthwise direction of the article of footwear; and assembling the foot width forming members to the foot length forming members.

2. The method for manufacturing a last according to claim 1, wherein the disposing includes:

generating a foot model for a user; and generating the foot width forming models from the foot model for forming the foot width forming members.

3. The method for manufacturing a last according to claim 2, wherein the foot model is a three-dimensional model generated from measured data of each part of a foot of the user; and the generating the foot model includes obtaining image data of the foot using a portable terminal capable of capturing an image.

4. The method for manufacturing a last according to claim 3, wherein the image data is obtained at a stationary store or a movable store visited by the user, or the user obtains the image data at the user's home and sends the image data to a server of a footwear manufacturer.

5. The method for manufacturing a last according to claim 3, wherein the generating the foot model includes using software installed in a smartphone used to image the user's foot or performing an operation on both the captured image data and data in a server used by a footwear manufacturer.

6. The method for manufacturing a last according to claim 2, wherein the foot model is formed in the same shape as a user's foot, or has a specific portion corrected from a shape of the user's foot by a desired dimension.

7. The method for manufacturing a last according to claim 2, wherein the generating the foot width forming models includes generating a last model based on the foot model and obtaining a shape of the last model in cross section in the widthwise direction.

8. The method for manufacturing a last according to claim 1, wherein the base member comprises paper, resin, or a butcher-block material.

9. The method for manufacturing a last according to claim 1, wherein the disposing includes performing plate nesting automatically by using dedicated software to densely dispose the foot length forming models and the foot width forming models on the base member.

10. The method for manufacturing a last according to claim 1, wherein the processing includes cutting the foot length forming members and the foot width forming members out of the base member.

11. The method for manufacturing a last according to claim 1, wherein the forming the footwear upper includes covering the last with an unformed upper made of a fiber sheet including a heat-shrinkable yarn and applying heat to form the unformed upper along the shape of the last to be a formed upper, knitting a material around the last directly, or performing additive manufacturing with a 3D printer.

12. The method for manufacturing a last according to claim 1, wherein the processing includes forming a position identifier with a mark on each of the foot length forming members and the foot width forming members, and the assembling includes matching the mark in direction to face the foot width forming members in a correct direction.

13. The method for manufacturing a last according to claim 12, wherein the forming the position identifier includes laser printing.

14. The method for manufacturing a last according to claim 13, wherein the laser printing includes engraving on each of the foot length forming members and the foot width forming members.

15. The method for manufacturing a last according to claim 12, wherein the position identifier includes a two-dimensional code, a one-dimensional code, or an integrated circuit chip.

* * * * *